US005399056A

United States Patent [19]

Shibazaki et al.

[11] Patent Number: 5,399,056

[45] Date of Patent: Mar. 21, 1995

[54] METHOD FOR CONTROLLING A FINAL PILE DIAMETER IN A CAST-IN-PLACE OF SOLIDIFICATION PILE

[75] Inventors: Mitsuhiro Shibazaki, Akazukashinmachi; Hiroshi Yoshida, Tokorozawa, both of Japan

[73] Assignee: Chemical Grouting Co., Ltd., Tokyo, Japan

[21] Appl. No.: 112,074

[22] Filed: Aug. 26, 1993

[51] Int. Cl.[6] ..... E02D 3/10

[52] U.S. Cl. ..... 405/233; 175/67; 405/248; 405/266; 405/269; 405/232; 405/237; 299/16

[58] Field of Search ..... 405/233, 248, 269, 232, 405/237; 175/67, 424; 299/16, 17

[56] References Cited

U.S. PATENT DOCUMENTS

| | | | |
|---|---|---|---|
| 1,853,379 | 4/1932 | Rotinoff | 175/67 X |
| 3,851,490 | 12/1974 | Matsushita | 175/67 X |
| 4,433,943 | 2/1984 | Pao Chen | 405/233 X |
| 4,640,649 | 2/1987 | Nakanishi | 405/233 X |
| 4,850,440 | 7/1989 | Smet | 175/67 |

FOREIGN PATENT DOCUMENTS

| | | | |
|---|---|---|---|
| 546439 | 4/1956 | Belgium | 175/67 |
| 1440479 | 6/1976 | United Kingdom | 175/67 |
| 1025857 | 6/1983 | U.S.S.R. | 175/67 |

*Primary Examiner*—Dennis L. Taylor
*Attorney, Agent, or Firm*—Armstrong, Westerman, Hattori, McLeland & Naughton

[57] ABSTRACT

An apparatus for forming a pile produces a predetermined pile diameter in a cast-in-place pile. The apparatus includes an agitating arrangement which includes a pipe extending longitudinally into the ground, a plurality of agitating blades supported by the pipe for agitating a settable mixture, and a plurality of nozzles respectively disposed on and supported by respective ones of the agitating blades. Each of the plurality of nozzles produces a directional jet flow of liquid. Also, an arrangement is provided for supplying liquid under pressure to each of the plurality of nozzles. At least two of the plurality of nozzles are disposed such that the two nozzles are spaced apart a predetermined distance along the longitudinal direction of the pipe, and are oriented such that fluid flow from the two nozzles intersects, as viewed along the longitudinal axis of the pipe, at a predetermined radial distance from the pipe, forming a cross jet flow at the predetermined radial distance to establish an outermost mixing of hardener and settable mixture, thereby forming a final hardened pile diameter at the predetermined radial distance.

4 Claims, 1 Drawing Sheet

Fig.1
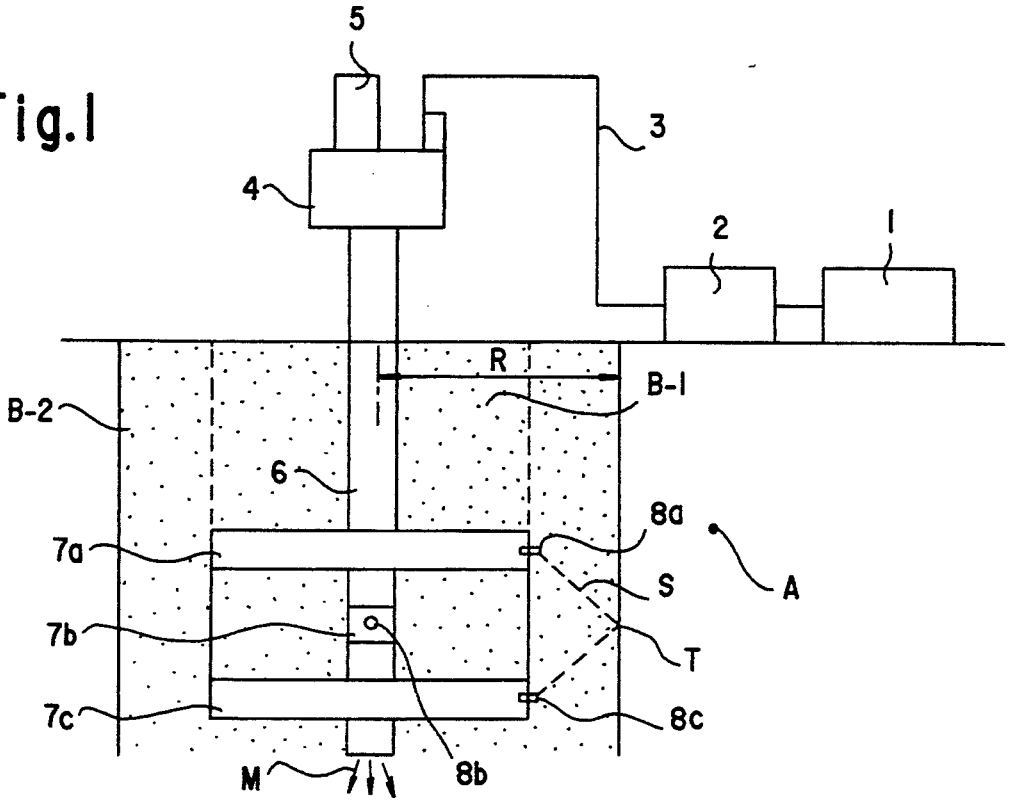
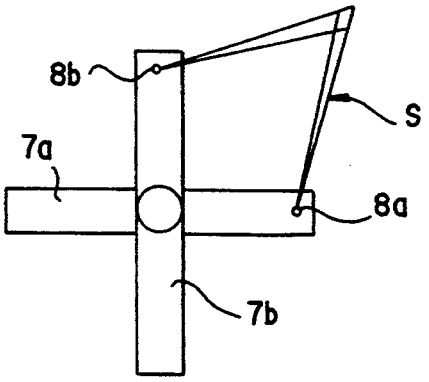
Fig.2
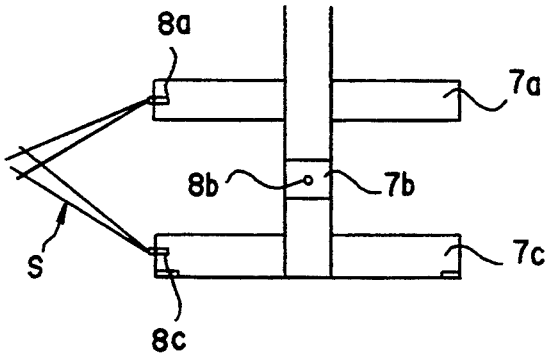
Fig.3

METHOD FOR CONTROLLING A FINAL PILE DIAMETER IN A CAST-IN-PLACE OF SOLIDIFICATION PILE

APPLICATION FIELD IN THE INDUSTRY

The present invention relates to a method for controlling a final pile diameter in a cast-in-place of solidification pile within the ground by a combination of high pressure jet flow and mechanical agitation.

PRIOR ART

A method for casting in place a solidification pile within the ground by a combination of high pressure jet flow and mechanical agitation for improving a soil condition is known.

In such a method a hardening agent is delivered from the central region of the pipe at a low pressure without injecting a high pressure jet flow directly from the pipe inserted into the ground, wherein an agitation at a predetermined distance from the pipe is carried out mechanically by several stages of agitation blade mounted on the central pipe and in addition a high pressure jet of water or hardening agent is injected from the tip or middle of the agitation blade into the ground for casting in place a solidification pile or a cylindrical pipe-shaped pile.

PROBLEMS TO BE SOLVED BY THE INVENTION

While in the above-described method a cylindrical pipe-shaped cast-in-place pile having a predetermined thickness is added outside the pile casted in place by the agitating blades, it is preferable to be capable of selecting a predetermined thickness according to a situation. For this purpose it is necessary to control a throw-distance of the jet flow.

Now, at an injection of high pressure jet flow into the ground a throw-distance of jet flow depends on a soil condition and a soil property (strength, water content, void ratio) so that it was a practice preferably used in the prior art to provide a final diameter of cast-in-place pile somewhat larger than required by injecting water or hardening agent with an excessive power. It results in such a problem as a loss of material and an outflow of a lot of slime, etc.

Therefore, it is an object of the present invention to solve such a disadvantage as a loss of material etc. in the prior method by allowing a predetermined thickness of cast-in-place pile to be selected depending on the situation by controlling easily a throw-distance of jet flow.

MEANS FOR SOLVING THE PROBLEMS

According to the present invention, in the cast-in-place of solidification pile within the ground by a combination of high pressure jet flow and mechanical agitation at least two nozzles provided on the agitating blades mounted on a pipe inserted into the ground and spaced in an appropriate interval in the longitudinal direction of the pipe is used as a nozzle for injecting water or hardening agent, wherein an injection angle of these nozzles is adjustable so that a cross jet flow can be established by adjusting the injection angle of nozzles according to a required throw-distance for controlling the final pile diameter.

OPERATION

It is known that when the fluids injected from 2 or more delivery ports join to each other an energy of combined jet flow will be reduced depending on their cross angle. It is possible to obtain a predetermined final pile diameter by controlling the throw-distance of the combined jet flow according to the above-described principle.

In the prior art a freedom for controlling the final pile diameter on the basis of a fixed relation between an injection flow and a cross-section of delivery port of nozzle, etc. was not given so that it was difficult to attain an efficient use of material and a suppression of slime outflow. By using a cross jet flow according to the present invention, a final cast-in-place pile diameter corresponding to a design can be selected freely by a flow rate of hardening agent, by a cross-section of the delivery port as well as by a nozzle angle. While a doubled number of jet flow are required for obtaining a cross flow, the number of crossing the soil per unit depth is increased in double so that an agitating efficiency will be increased remarkably by an increased number of jet flow.

BRIEF DESCRIPTION OF THE DRAWING

FIG. 1 shows an apparatus to perform a method for controlling a final pile diameter in a cast-in-place of solidification pile by a jet process according to the present invention.

FIG. 2 shows a first example of injecting direction.

FIG. 3 shows a second example of injecting direction.

EMBODIMENT

An embodiment of the present invention will be explained below with reference to the drawings.

In the drawings, 1 refers to a generator, 2 refers to a high pressure pump driven by the generator 1, 3 refers to a piping, 4 refers to a swivel joint connecting a pipe inserted into the ground to the piping 3, 5 refers to an agitating process machine, 6 refers to a pipe inserted into the ground, *7a*, *7b*, *7c* refer to several stages of agiatating blade mounted on the pipe 6 and spaced in an interval in the longitudinal direction of the pipe 6 and 8*a*, 8*b*, 8*c* refer to nozzles provided on the agiatating blades *7a*, *7b*, *7c*, the injection angle of these nozzles 8*a*, 8*b*, 8*c* being adjustable.

The nozzles 8*a*, 8*b* can be provided on the agiatating blades *7a*, *7b* crossing each other in an adjacent relation as shown in FIG. 2 or the nozzles 8*a*, 8*c* can be provided on the agiatating blades *7a*, *7c* parallel to each other in an alternative relation as shown in FIG. 3. The water or hardening agent is injected from the nozzles 8*a*, 8*b*, (8*c*) provided on the agiatating blades *7a*, *7b*, (*7c*) through the swivel joint 4 by the high pressure pump 2. In this case it is assumed that a hardening agent is injected wherein cement milk, mortar and chemical agent are enumerated as a hardening agent. The angle of each of the nozzles 8*a*, 8*b*, (8*c*), which angle is adjustzble, is preset such that a cross jet flow S will be established (such that each of the jet flow will meet). The cross angle $\alpha$ is preset to an angle predetermined depending on the throw-distance.

An injection timing of the jet flow is determined according to the situation of construction so that the jet flow can be injected when the pipe 6 is advanced or when the pipe 6 is retracted depending on the situation.

Concerning a mechanical agitation with the agitating blades 7*a*, 7*b*, 7*c*, an agitation cast-in-place pile B-1 can be constructed by an agitation, e.g., when a hardening agent M is delivered from the front end of the pipe 6 at a low pressure. Simultaneously, when the process machine 5 is displaced either upwards or downwards while the hardening agent is injected from the nozzles 8*a*, 8*b*, (8*c*) and the pipe 6 is rotated, a column-like cast-in-place pile B-2 is constructed integrally within the ground A, wherein the cast-in-place pile B-2 has the outermost edge R corresponding to the joining point T of the cross flow S as shown in the drawings.

The above-described method can be applied not only to the chemical charging pile method injecting a hardening agent from the nozzle but also to the jet grout method filling a hardening agent in fluid into the void provided by cutting the ground with a water injected from the nozzle.

We claim:

1. A method for controlling a final pile diameter in a cast-in-place pile by a combination of mechanical agitation and a jet process, comprising the steps of:

agitating a settable mixture using a plurality of agitating blades supported by a pipe while injecting a hardening agent within the ground while simultaneously agitating the settable mixture using high pressure jet flow produced by at least two nozzles respectively disposed on different ones of said plurality of agitating blades by providing pressurized fluid through said pipe, said nozzles being spaced apart a predetermined distance along a longitudinal direction of said pipe, said nozzles being directional and being oriented such that fluid flow from said at least two nozzles intersects, as viewed along said longitudinal axis of said pipe, at a predetermined radial distance from said pipe, whereby a cross jet flow is established at said predetermined radial distance to establish an outermost mixing of hardener and settable mixture, whereby a final hardened pile diameter forms at said predetermined radial distance.

2. An apparatus for forming a pile having a predetermined pile diameter in a cast-in-place pile, comprising:

an agitating apparatus comprising:

a pipe extending longitudinally into the ground;

a plurality of agitating blades supported by said pipe, for agitating a settable mixture;

a plurality of nozzles respectively disposed on and supported by respective ones of said agitating blades, each of said plurality of nozzles producing a directional jet flow of liquid; and means for supplying liquid under pressure to each of said plurality of nozzles;

whereby at least two of said plurality of nozzles are disposed such that said two nozzles are spaced apart a predetermined distance along the longitudinal direction of said pipe, said nozzles being oriented such that fluid flow from said at least two nozzles intersects as viewed along said longitudinal axis of said pipe at a predetermined radial distance from said pipe, whereby a cross jet flow is established at said predetermined radial distance to establish an outermost mixing of hardener and settable mixture, whereby a final hardened pile diameter forms at said predetermined radial distance.

3. An apparatus for forming a pile as claimed in claim 2, wherein adjacent ones of said plurality of agitating blades extend from said pipe transversely to each other.

4. An apparatus for forming a pile as claimed in claim 2, wherein a direction of orientation of each of said nozzles is adjustable in an axial direction and in a horizontal direction.

* * * * *